US011228119B2

(12) United States Patent
Schwartz et al.

(10) Patent No.: US 11,228,119 B2
(45) Date of Patent: Jan. 18, 2022

(54) PHASED ARRAY ANTENNA SYSTEM INCLUDING AMPLITUDE TAPERING SYSTEM

(71) Applicant: Palo Alto Research Center Incorporated, Palo Alto, CA (US)

(72) Inventors: David Eric Schwartz, Concord, MA (US); Shabnam Ladan, Menlo Park, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 85 days.

(21) Appl. No.: 16/715,014

(22) Filed: Dec. 16, 2019

(65) Prior Publication Data

US 2021/0184372 A1 Jun. 17, 2021

(51) Int. Cl.

| | |
|---|---|
| ***H01Q 21/22*** | (2006.01) |
| ***H01Q 3/36*** | (2006.01) |
| ***H01Q 3/22*** | (2006.01) |

(52) U.S. Cl.

CPC ..... *H01Q 21/22* (2013.01); *H01Q 3/22* (2013.01); *H01Q 3/36* (2013.01)

(58) Field of Classification Search

CPC ..... H01Q 21/22; H01Q 3/22; H01Q 3/36

See application file for complete search history.

(56) References Cited

U.S. PATENT DOCUMENTS

| | | | | |
|---|---|---|---|---|
| 4,642,645 | A | 2/1987 | Haupt | |
| 5,017,928 | A | 5/1991 | Haupt et al. | |
| 5,504,493 | A | 4/1996 | Hirshfield | |
| 5,557,291 | A | 9/1996 | Chu et al. | |
| 5,955,992 | A * | 9/1999 | Shattil | H04B 7/0697 342/375 |
| 6,188,373 | B1 | 2/2001 | Martek | |
| 7,026,989 | B1 | 4/2006 | Minkoff et al. | |
| 7,280,070 | B2 | 10/2007 | Pillai | |
| 7,907,100 | B2 | 3/2011 | Mortazawi et al. | |
| 8,358,239 | B2 | 1/2013 | Krich et al. | |
| 9,130,270 | B1 | 9/2015 | Nelson | |
| 9,252,485 | B2 | 2/2016 | Haskell et al. | |
| 10,454,187 | B2 | 10/2019 | Zhai et al. | |
| 10,594,031 | B1 * | 3/2020 | West | H01Q 21/0025 |
| 2007/0109179 | A1 * | 5/2007 | Werntz | G01S 13/904 342/174 |
| 2011/0122026 | A1 | 5/2011 | Delaquil et al. | |
| 2018/0026683 | A1 * | 1/2018 | Manholm | H04B 7/0617 375/267 |
| 2018/0358696 | A1 | 12/2018 | Shapoury | |
| 2021/0018599 | A1 * | 1/2021 | Lu | G01S 17/42 |
| 2021/0066813 | A1 * | 3/2021 | Salman | H01Q 3/24 |

* cited by examiner

*Primary Examiner* — Seokjin Kim

(74) *Attorney, Agent, or Firm* — Mueting Raasch Group

(57) ABSTRACT

A phased array antenna system comprises a feeding network which includes power combiners/dividers and an amplitude tapering system. The phased array antenna system comprises a plurality of antenna elements coupled to the feeding network. The amplitude tapering system is configured to generate amplitude coefficients and apply an amplitude tapering function on a transmitted or received radio frequency signal. The amplitude tapering function comprises a combination of a least two disparate amplitude tapering functions.

20 Claims, 11 Drawing Sheets

PHASED ARRAY ANTENNA SYSTEM INCLUDING AMPLITUDE TAPERING SYSTEM

BACKGROUND

Phased array antenna systems can employ tapering techniques to help suppress sidelobes generated by the system. It is well known that designing a low sidelobe phased antenna array is a complicated procedure. In theory, creating low sidelobes results from adjusting the signal amplitude at every single antenna element of an array using amplitude tapering. However in practice, the amplitude adjustments are also impacted by the coupling coefficients of the power divider in the feeding network. Feeding networks are simple when they have equal amplitude weight. This kind of feeding network is designed to provide uniform amplitude tapering which provides good directivity but the sidelobes remain high. To achieve almost the same directivity with lower sidelobes, non-uniform amplitude tapering techniques are available. These low sidelobe distributions apply different amplitude weights at every antenna element in the array. However, available non-uniform amplitude tapering techniques do not meet the conditions of being easy to design, build, test, and maintain.

SUMMARY

Embodiments are directed to a phased array antenna system comprising a feeding network which includes power combiners/dividers and an amplitude tapering system. The phased array antenna system comprises a plurality of antenna elements coupled to the feeding network. The amplitude tapering system is configured to generate amplitude coefficients and apply an amplitude tapering function on a transmitted or received radio frequency signal. The amplitude tapering function comprises a combination of a least two disparate amplitude tapering functions.

Embodiments are directed to a phased array antenna system comprising a feeding network which includes power combiners/dividers and an amplitude tapering system. The phased array antenna system comprises a plurality of antenna elements coupled to the feeding network. The amplitude tapering system is configured to generate amplitude coefficients and apply an amplitude tapering function on a transmitted or received radio frequency signal. The amplitude tapering function comprises a combination of a Chebyshev amplitude taper function and a Kaiser amplitude taper function such that a relative amplitude of a radio frequency signal applied to or received from each of the antenna elements is determined by a combination of Kaiser and Chebyshev amplitude taper coefficients.

Embodiments are directed to a method implemented by a phased array antenna system comprising transmitting or receiving radio frequency signals by a phased array antenna coupled to a feeding network comprising power combiners/dividers and an amplitude tapering system. The method also comprises applying, by the amplitude tapering system, an amplitude tapering function on a transmitted or received radio frequency signal, the amplitude tapering function comprising a combination of a least two disparate amplitude tapering functions. The method further comprises producing an antenna pattern with reduced sidelobes and narrower main lobe bandwidth relative to an antenna pattern producible by application of any one of the at least two disparate amplitude tapering functions.

In accordance with any of the embodiments disclosed herein, the phased array antenna system can also include a plurality of phase shifters each coupled to one of the plurality of antenna elements and the feeding network. A phase control can be operatively coupled to the plurality of phase shifters and configured to adjust a phase shift of each of the phase shifters to electronically steer an antenna array pattern.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
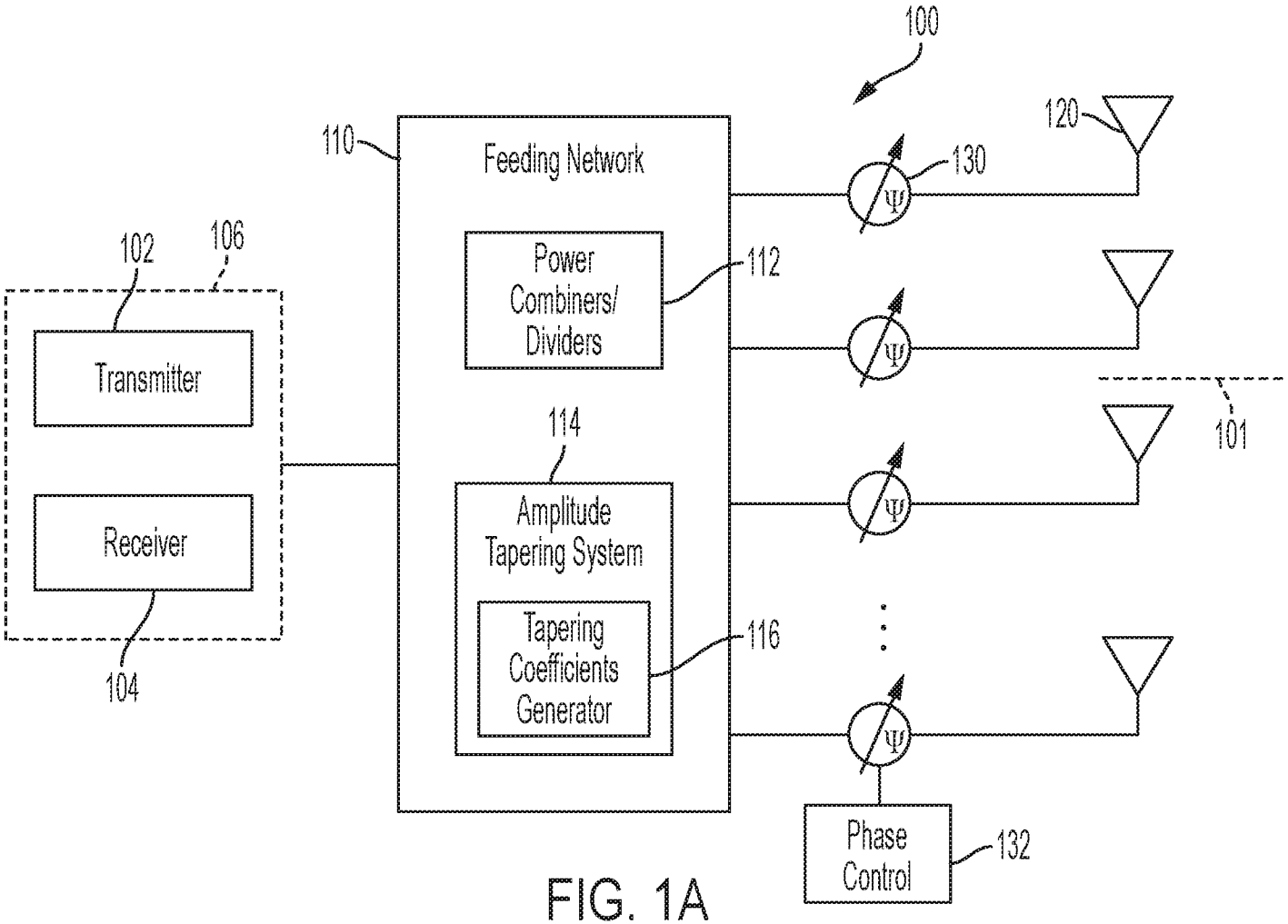
FIGS. 1A and 1B illustrate a phased array antenna system which incorporates an amplitude tapering system configured to generate amplitude coefficients and apply an amplitude tapering function comprising a combination of a least two disparate amplitude tapering functions on a transmitted or received radio frequency signal in accordance with various embodiments.
Figure 1B:
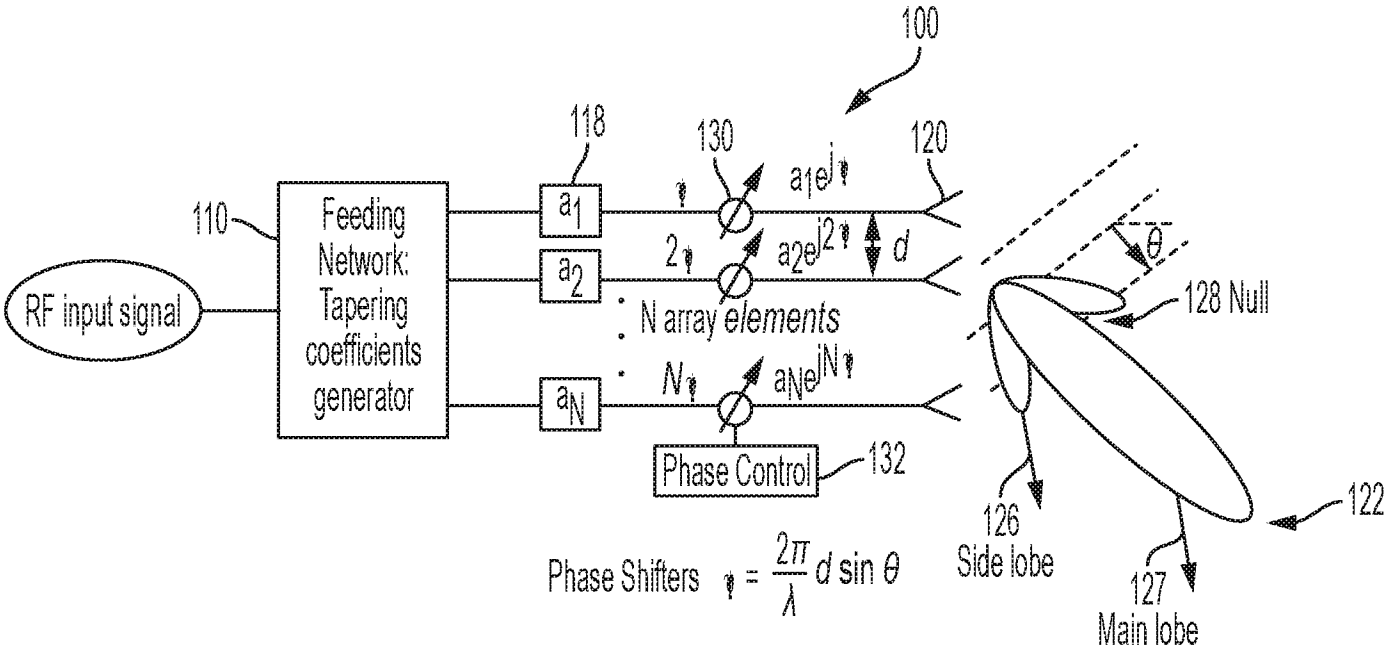

FIGS. 1A and 1B illustrate a phased array antenna system 100 configured to couple to one or both of a radio frequency (RF) transmitter 102 and an RF receiver 104. In some configurations, the phased array antenna system 100 is configured to couple to an RF transceiver 106, which includes both the RF transmitter 102 and the RF receiver 104. One or both of the RF transmitter 102 and the RF receiver 104 is/are coupled to a feeding network 110. The phased array antenna system 100 includes a plurality of antennas 120. According to some embodiments, each of the antennas 120 is coupled to one of a plurality of phase shifters 130 and to the feeding network 110. A phase control 132, which can include one or more processors among other components, is operably coupled the phase shifters 130. The phase control 132 is configured to adjust a phase shift of each of the phase shifters 130 to electronically steer an antenna array pattern 122, such as in one or both of an azimuth plane and an elevation plane. The phase shifters 130 rotate the antenna array pattern 122 after an RF signal is coupled to the antennas 120 through the feeding network 110. The antenna array pattern 122 can be steered by the phase control 132 and the phase shifters 130 when the phased array antenna system 100 operates in a transmit mode and/or in a receive mode.

The antennas 120 of the phased array antenna system 100 cooperate to create a beam of radio waves that can be electronically steered to a location in a desired direction without moving the antennas 120. The antennas 120 can also be electronically steered to a location in a desired direction when receiving radio waves from a target source or to avoid external sources of interference. In a transmit mode, radio frequency current generated by the RF transmitter 102 is fed to the feeding network 110 and to the individual antennas 120 with the correct phase relationship via the phase shifters 130 so that the radio waves from the separate antennas 120 add together to increase the radiation in a desired direction, while canceling or suppressing radiation in undesired directions. By changing the phase of the phase shifters 130, the phase control 132 can change the angle or angles of the main beam 127 and null(s) 128 of the antenna array pattern 122. For example, the phase control 132 can adjust the phase of the phase shifters 130 to cause the antenna array pattern 122 to be directed at a desired angle (e.g., an azimuth angle or an elevation angle) or angles relative to an axis 101 of the phased array antenna system 100.

According to other embodiments, the phased array antenna system 100 can be configured to create a beam of radio waves that can be directed in a fixed direction. The fixed direction of the antenna array pattern 122 can be any desired direction. According to embodiments that do not include the phase shifters 130, each of the antennas 120 is coupled to the feeding network 110.

The feeding network 110 includes power combiners/dividers 112. Depending on the particular configuration of the phased array antenna system 100, the feeding network 110 can include a single power combiner/divider 112 or, in more complex configurations, any number of power combiners/dividers 112. The power combiners/dividers 112 can be implemented as a Wilkinson power divider, a hybrid coupler, a directional coupler, or any other circuit that can combine and/or divide signals. Each of the power combiners/dividers 112 can combine and/or divide signals passing through the feeding network 110. For example, the power combiners/dividers 112 can be configured to split a common RF signal generated by the transmitter 102 between a multiplicity of antennas 120, and to combine a multiplicity of signals received by the antennas 120 into a single output for reception by the receiver 104.

The feeding network 110 also includes an amplitude tapering system 114. Among other components, the amplitude tapering system 114 includes a generator 116 configured to generate tapering (weighting) coefficients 118. The amplitude tapering system 114 is configured to generate amplitude tapering coefficients 118 via the tapering coefficients generator 116 and apply an amplitude tapering function on a transmitted or received radio frequency signal. The amplitude tapering function applied by the amplitude tapering system 114 comprises a combination of at least two disparate amplitude tapering functions.

The term "disparate amplitude tapering functions" refers to different amplitude tapering functions each having a characteristic (e.g., unique) tradeoff between main lobe bandwidth and sidelobe level suppression. The most common and standard amplitude tapering functions which are widely used in designing phased array antenna systems include Hamming, Hann, Chebyshev, Taylor, and Kaiser. Other common and standard amplitude tapering functions include Blackman, Gaussian, Bartlett, Barthann, and Tukey, among others. Each of these standard amplitude tapering functions has a characteristic tradeoff between main lobe (127) bandwidth and sidelobe (126) level suppression.

Figure 2A:
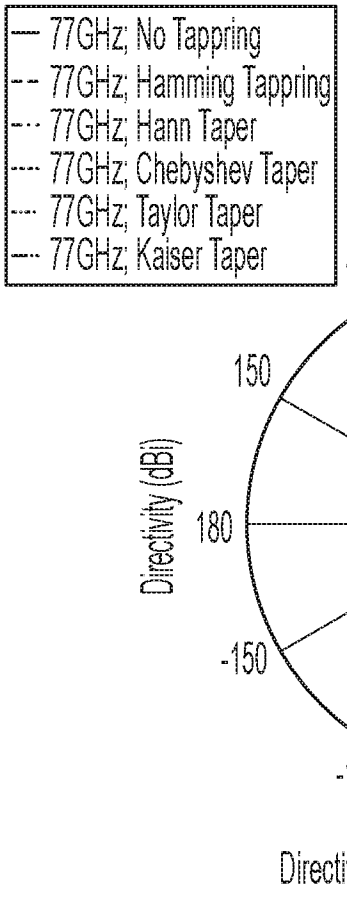
FIGS. 2A and 2B show a comparison of antenna patterns produced using no tapering and a number of disparate tapering techniques applied on a rectangular array of isotropic antenna elements.
Figure 2B:
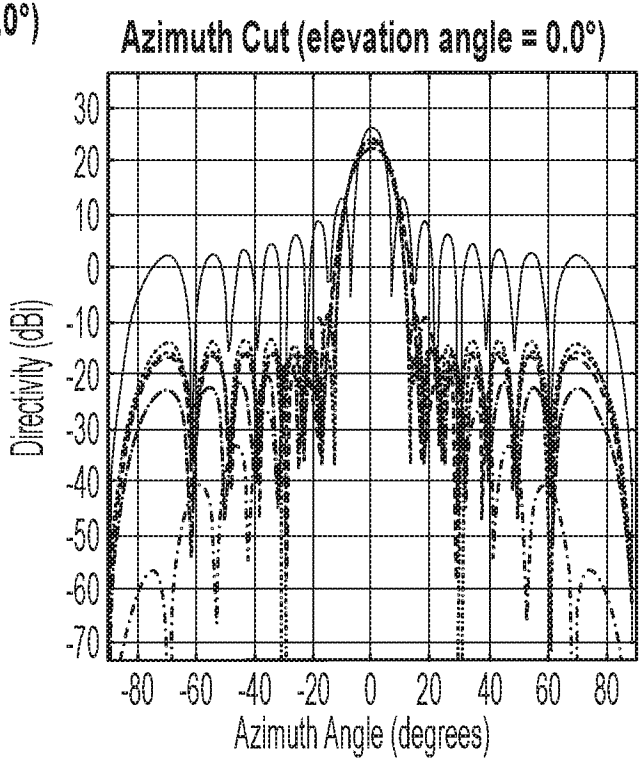

FIGS. 2A and 2B show a comparison of antenna patterns produced using Hamming, Hann, Chebyshev, Taylor, and Kaiser tapering functions applied on a rectangular array of 288 isotropic elements, uniformly spaced ($\lambda/2$), and operating at 77 GHz. The antenna patterns shown in FIGS. 2A and 2B also include an antenna pattern produced using no tapering function. As is shown in FIGS. 2A and 2B, all of these standard tapering techniques lower down the sidelobes but open the main beam to some degree. Each of these standard amplitude tapering functions has its own characteristics defined by its mathematical functions.

Among the above-mentioned techniques, the Chebyshev tapering function is the more popular. Compared to other tapering methods, the resulting array factor of the Chebyshev tapering function has the minimum null-null beamwidth (narrowest main lobe width) for the specified sidelobe suppression level. Also, the Fourier transform of the Chebyshev tapering function exhibits sidelobes with equal magnitude. These two features of the Chebyshev tapering function, minimum main lobe width and the even sidelobe level, make this technique particularly attractive to use.

Figure 3A:
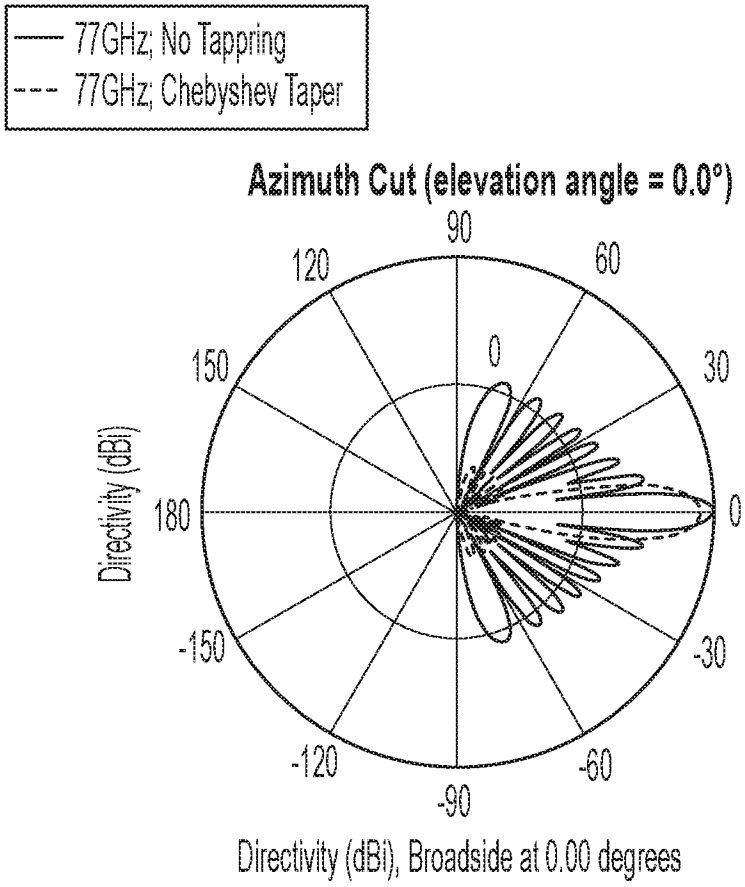
FIGS. 3A and 3B show a comparison of antenna patterns produced using no tapering and Chebyshev tapering applied on a rectangular array of isotropic antenna elements.
Figure 3B:
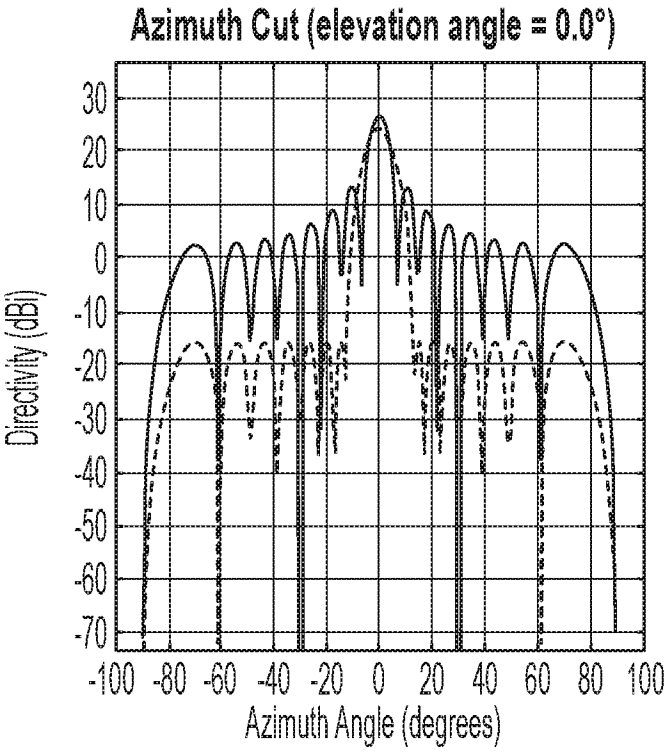
Figure 4B:
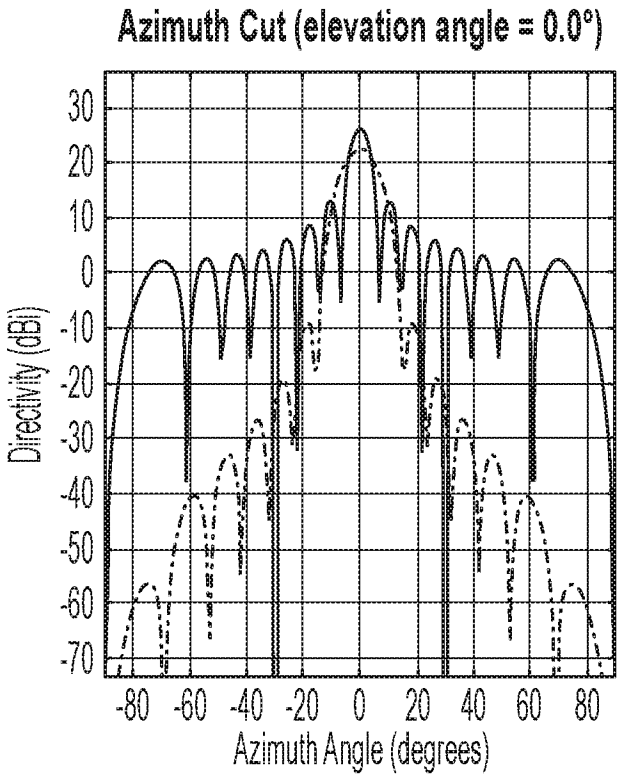
FIGS. 4A and 4B show a comparison of antenna patterns produced using no tapering and Hann tapering applied on a rectangular array of isotropic antenna elements.
Figure 4A:
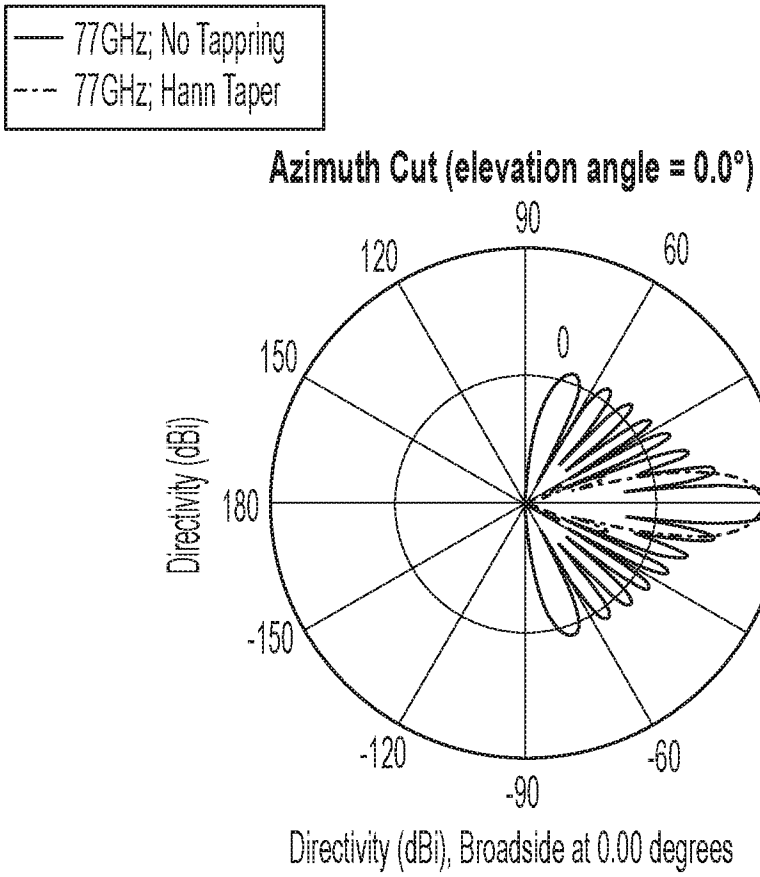
Figure 5B:
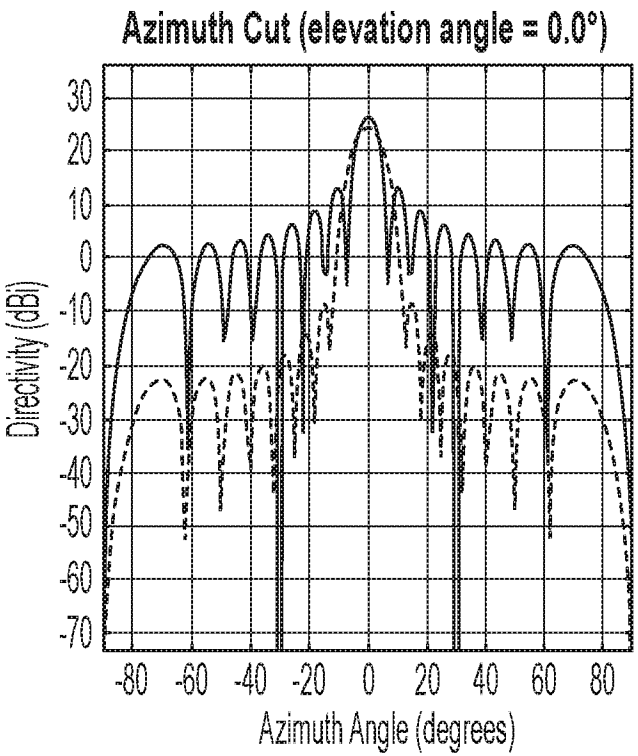
FIGS. 5A and 5B show a comparison of antenna patterns produced using no tapering and Kaiser tapering applied on a rectangular array of isotropic antenna elements.
Figure 5A:
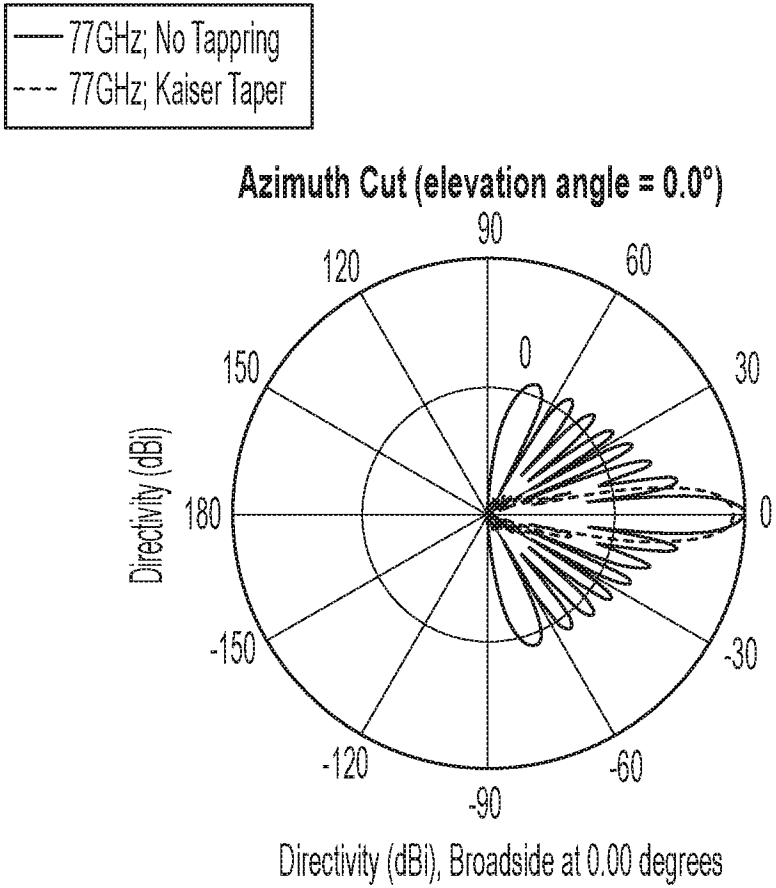

FIGS. 3A and 3B show the performance of Chebyshev tapering applied on an array of 288 elements operating at 77 GHz. FIGS. 4A and 4B show the performance of Hann tapering applied on an array of 288 elements operating at 77 GHz. FIGS. 5A and 5B show the performance of Kaiser tapering applied on an array of 288 elements operating at 77 GHz. In comparison to Chebyshev tapering shown in FIGS. 3A and 3B, Hann tapering (FIGS. 4A and 4B) and Kaiser tapering (FIGS. 5A and 5B) create more suppression in the sidelobes, but the sidelobes are not even in magnitude. Hann tapering (FIGS. 4A and 4B), when applied on a phased array antenna, uses a cosine wave on the array factor to suppress the sidelobes. Kaiser tapering (FIGS. 5A and 5B) provides a tradeoff between sidelobe level suppression and main beamwidth.

The essential parameter of the Kaiser tapering function, which is called $\beta$, controls the sidelobe level suppression and main beam opening. The value of $\beta$ can change from 0 to 10. Smaller values of $\beta$ create higher sidelobes with a narrower main lobe. Larger values of $\beta$ provide more suppression in the sidelobes. That being said, an optimum value of $\beta$ is one that provides a tradeoff between having lower sidelobes and opening in the main lobe.

The standard amplitude tapering (weighting) functions discussed above, as well as other known amplitude tapering functions, are suboptimal solutions when applied in a phased array antenna system. Referring to design requirements, an optimal amplitude tapering function would be one designed in such a way as to minimize the main lobe bandwidth or in other words to increase the directivity, to reduce the sidelobes level, and to have less complexity in implementation.

Embodiments of the disclosure are directed to a novel amplitude tapering technique for use in a phased array antenna system which suppresses and controls the generated sidelobes and provides for increased far-field radiation pattern directivity. An amplitude tapering technique of the present disclosure can be applied to any type of phased array antenna system, such as those that include a linear, a non-linear, a rectangular or a circular phased array antenna.

According to various embodiments, and as discussed previously with reference to FIGS. 1A and 1B, an amplitude tapering system 114 of a phased array antenna system 100 is configured to generate amplitude coefficients 118 and apply an amplitude tapering function comprising a combination of a least two disparate amplitude tapering functions on a transmitted or received RF signal. For example, the amplitude taper function can comprise a weighting parameter applied to an array factor of the phased array antenna, such that the weighting parameter comprises a linear combination of coefficients of at least two disparate amplitude tapering functions. The amplitude tapering function provided by the amplitude tapering system 114 can be an amplitude tapering function comprising at least two of a Chebyshev amplitude tapering function, a Kaiser amplitude tapering function, a Hamming amplitude tapering function, a Hann amplitude tapering function, a Taylor amplitude tapering function, and any other known amplitude tapering function.

An amplitude tapering function comprising a combination of a least two disparate amplitude tapering functions takes advantage of the strengths of the different amplitude tapering functions while minimizing undesirable behavior of these amplitude tapering functions. A phased array antenna system implemented in accordance with the embodiments of the disclosure can produce an antenna pattern with reduced sidelobes and narrower main lobe bandwidth when compared to an antenna pattern producible by application of any one of these and other known amplitude tapering functions.

Figure 6:
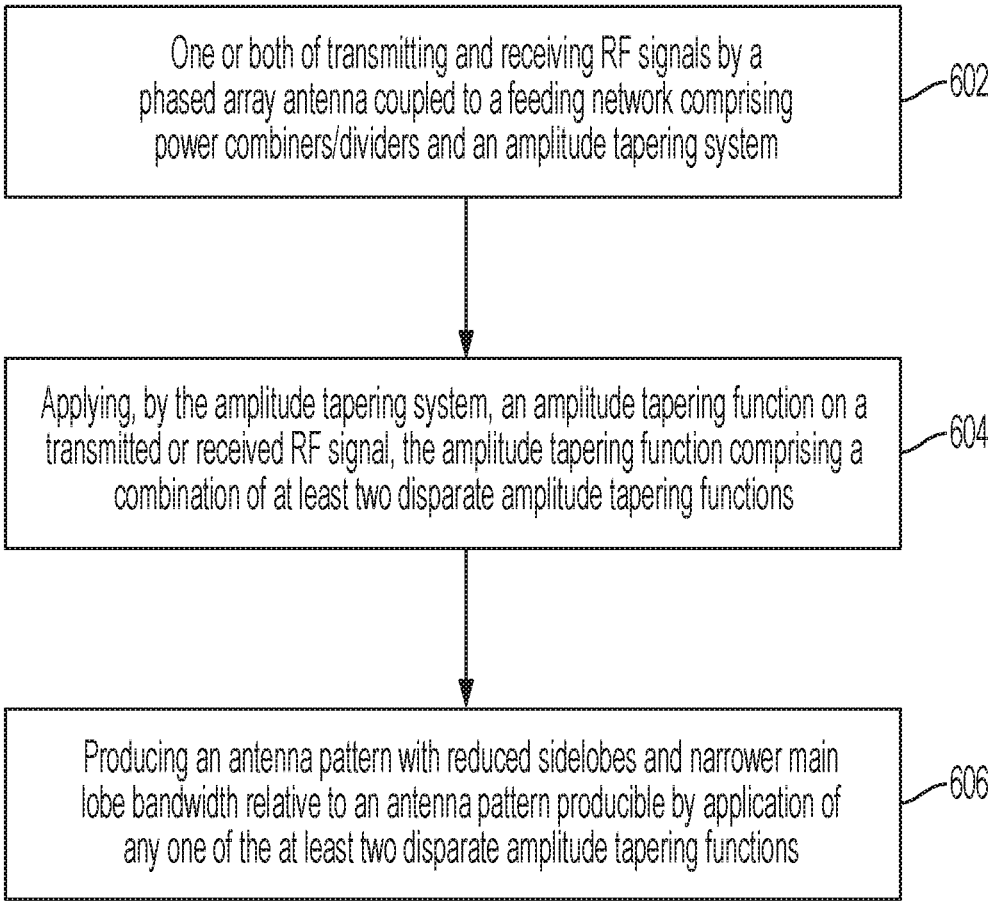
FIG. 6 illustrates a method implemented by a phased array antenna system in accordance with various embodiments.

FIG. 6 illustrates a method implemented by a phased array antenna system in accordance with various embodiments. The method shown in FIG. 6 involves one or both of transmitting and receiving 602 RF signals by a phased array antenna coupled to a feeding network comprising power combiners/dividers and an amplitude tapering system. The method also involves applying 604, by the amplitude tapering system, an amplitude tapering function on a transmitted or received RF signal. The amplitude tapering function comprises a combination of at least two disparate amplitude tapering functions. The method further involves producing 606 an antenna pattern with reduced sidelobes and narrower main lobe bandwidth relative to an antenna pattern producible by application of any one of the at least two disparate amplitude tapering functions.

Figure 7:
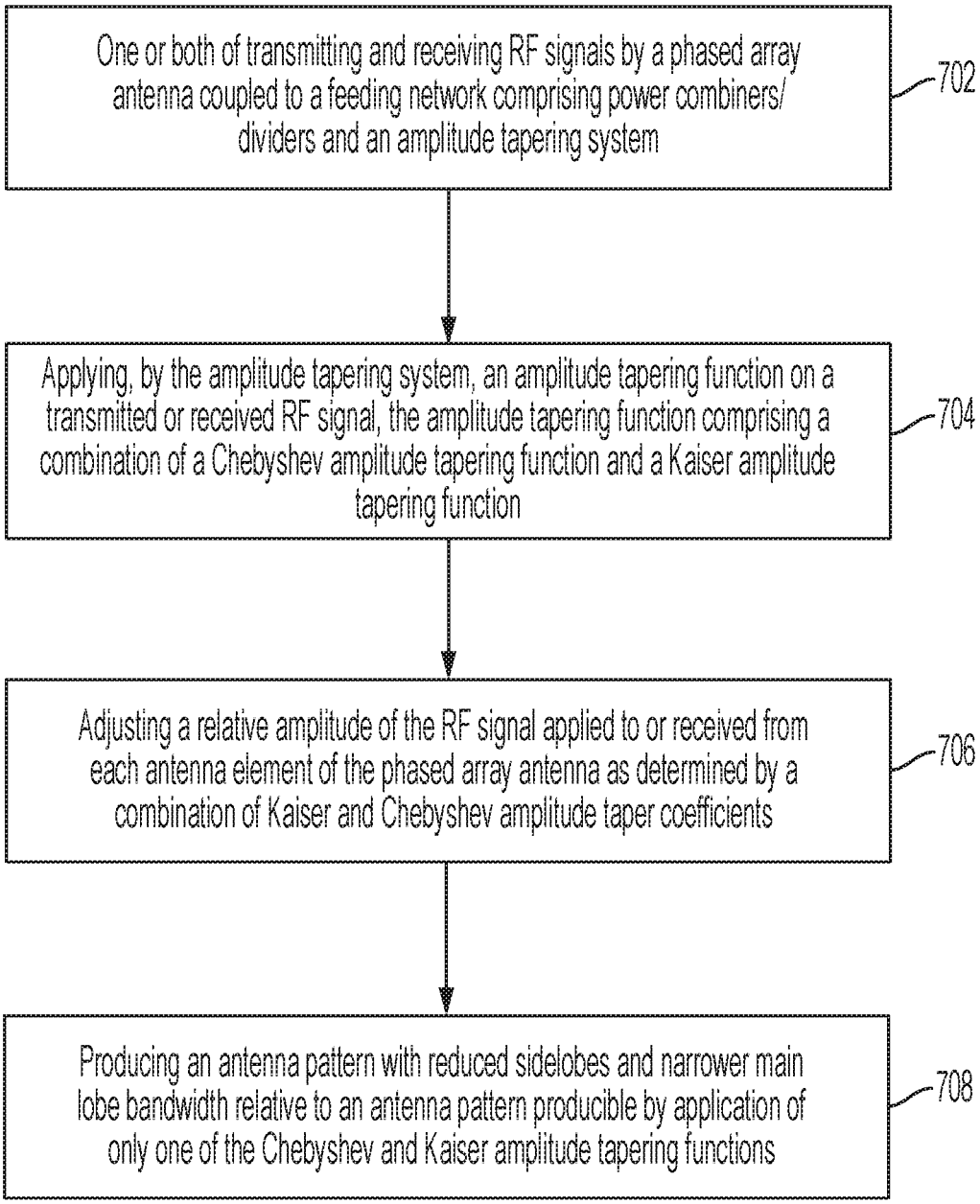
FIG. 7 illustrates a method implemented by a phased array antenna system in accordance with various embodiments.

FIG. 7 illustrates a method implemented by a phased array antenna system in accordance with various embodiments. The method shown in FIG. 7 involves one or both of transmitting and receiving 702 RF signals by a phased array antenna coupled to a feeding network comprising power combiners/dividers and an amplitude tapering system. The method also involves applying 704, by the amplitude tapering system, an amplitude tapering function on a transmitted or received RF signal. The amplitude tapering function comprises a combination of a Chebyshev amplitude tapering function and a Kaiser amplitude tapering function. The method further involves adjusting 706 a relative amplitude of the RF signal applied to or received from each antenna element of the phased array antenna as determined by a combination of Kaiser and Chebyshev amplitude taper coefficients. The method also involves producing 708 an antenna pattern with reduced sidelobes and narrower main lobe bandwidth relative to an antenna pattern producible by application of only one of the Chebyshev and Kaiser amplitude tapering functions.

Figure 8:
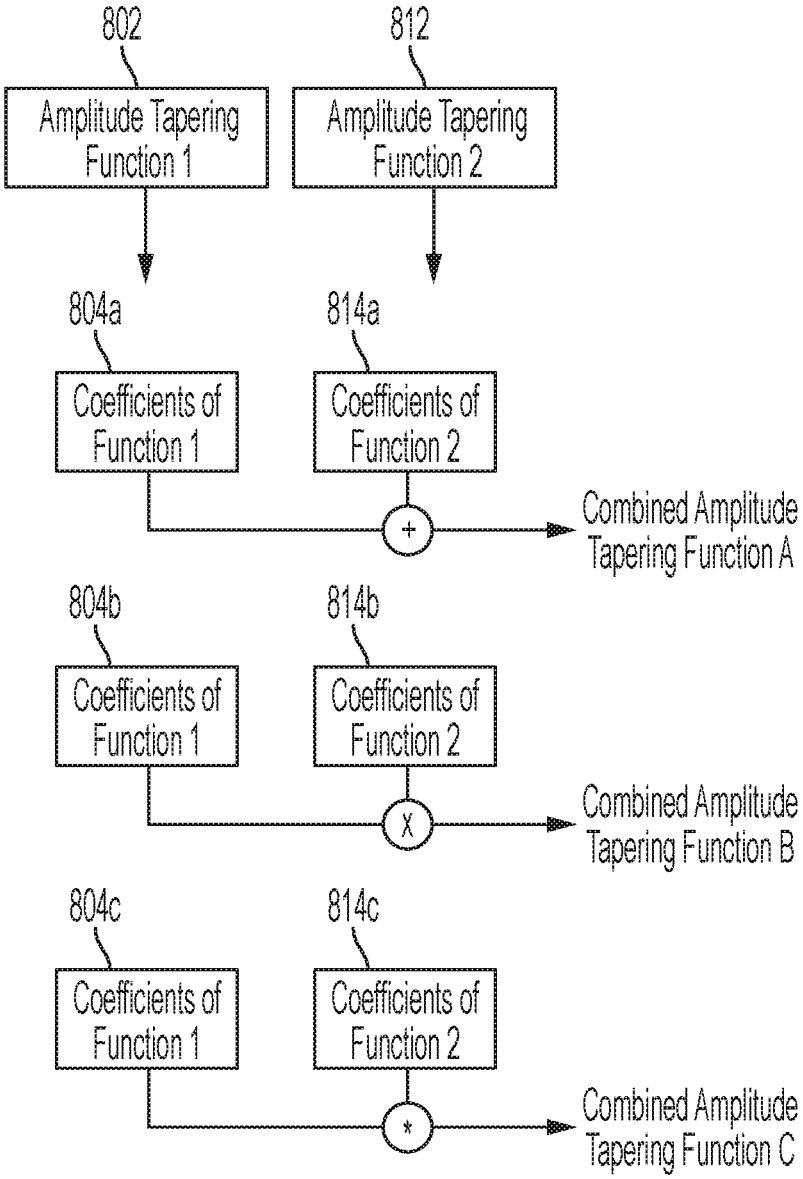
FIG. 8 illustrates various representative approaches to generating an amplitude tapering function in accordance with various embodiments.

FIG. 8 illustrates various representative approaches to generating an amplitude tapering function in accordance with various embodiments. The illustrative methods shown in FIG. 8 involve generating an amplitude tapering function by combining two disparate amplitude tapering functions 802, 812 in accordance with various embodiments. According to one approach to combining disparate amplitude tapering functions 802, 812, coefficients 804*a* of amplitude tapering function 1 and coefficients 814*a* of amplitude tapering function 2 are linearly combined to generate combined amplitude tapering function A. According to another approach to combining disparate amplitude tapering functions 802, 812, coefficients 804*b* of amplitude tapering function 1 and coefficients 814*b* of amplitude tapering function 2 are multiplied together to generate combined amplitude tapering function B. According to a further approach to combining disparate amplitude tapering functions 802, 812, amplitude tapering function C is generated by convolving coefficients 804*c* of amplitude tapering function 1 with coefficients 814*c* of amplitude tapering function 2.

It is noted that each of amplitude tapering functions A, B, and C provides a different tradeoff between main lobe bandwidth and sidelobe level suppression. It was found that for some combinations of disparate amplitude tapering functions (e.g., Chebyshev and Kaiser functions), generating a combined amplitude tapering function produced by a linear combination of selected coefficients of each function produced the most desirable trade-off between main lobe bandwidth and sidelobe level suppression. In general, linearly combining, multiplying or convolving at least two disparate amplitude tapering functions produces a combined amplitude tapering function that provides a more desirable tradeoff between main lobe bandwidth and sidelobe level suppression when compared to any one of the disparate amplitude tapering functions alone.

According to some embodiments, an amplitude tapering system of the present disclosure can be configured to apply an amplitude tapering function constructed by combining Chebyshev and Kaiser functions. In the following illustrative example, coefficients of Chebyshev and Kaiser functions are combined to produce an amplitude tapering function that takes advantage of the strengths of Chebyshev and Kaiser functions to enhance sidelobe suppression. More particularly, the combined amplitude tapering function minimizes main lobe beamwidth while maintaining a peak sidelobe constraint.

Simulations were performed in which three different combinations (a linear combination, multiplication, and convolution) of Chebyshev and Kaiser coefficients were examined. Among these three combinations of coefficients, it was found that a linear combination of Chebyshev and Kaiser coefficients provided the most desirable results in terms of creating more sidelobe level suppression and causing less main beam opening.

In this illustrative tapering example, the Kaiser coefficients and Chebyshev coefficients are linearly combined using a weighting parameter, w(k), and are applied to the array factor of the phased array system. In a general case, the weighting parameter, w(k), is given by:

$$w(k)=\alpha_1 * w_K(k)+\alpha_2 * w_C(k).$$

In the case where the weighting parameter, w(k), is optimized based on a normalized weighting parameter α, the weighting parameter, w(k), is given by:

$$w(k)=w_K(k)+\alpha\times w_C(k)$$

where, the frequency response of the Kaiser window is given by:

$$w_K(k)=\frac{N}{I_0(\beta)}\frac{\sin\left(\sqrt{(\pi k/N)^2-\beta^2}\right)}{\sqrt{(\pi k/N)^2-\beta^2}}$$

where, $I_0$ is the zero-th order modified Bessel function of the first kind and β controls the tradeoff between main lobe bandwidth and sidelobe level suppression. The frequency response of the Chebyshev window is given by:

$$w_C(k)=\frac{\cos\left\{N\cos^{-1}\left[\gamma\cos\left(\frac{\pi k}{N}\right)\right]\right\}}{\cosh(N\cosh^{-1}(\gamma))}$$

$$\gamma=\cosh\left[\frac{1}{N}\cosh^{-1}\left(10^{\frac{-20}{s}}\right)\right]$$

where, s determines the sidelobe level with respect to the main lobe peak, N represents the width of windows, and a is a weighting parameter.

An important objective of the illustrative tapering method is to find optimum values of β and α in such a way that the target sidelobe level is achieved. General constraints that are used for parameter optimization are main lobe bandwidth and flat sidelobes. An amplitude tapering function that combines coefficients of at least two disparate amplitude tapering functions (e.g., Chebyshev and Kaiser) effectively and efficiently controls sidelobe level suppression while minimizing main lobe beamwidth with less complexity in implementation.

Figure 9A:
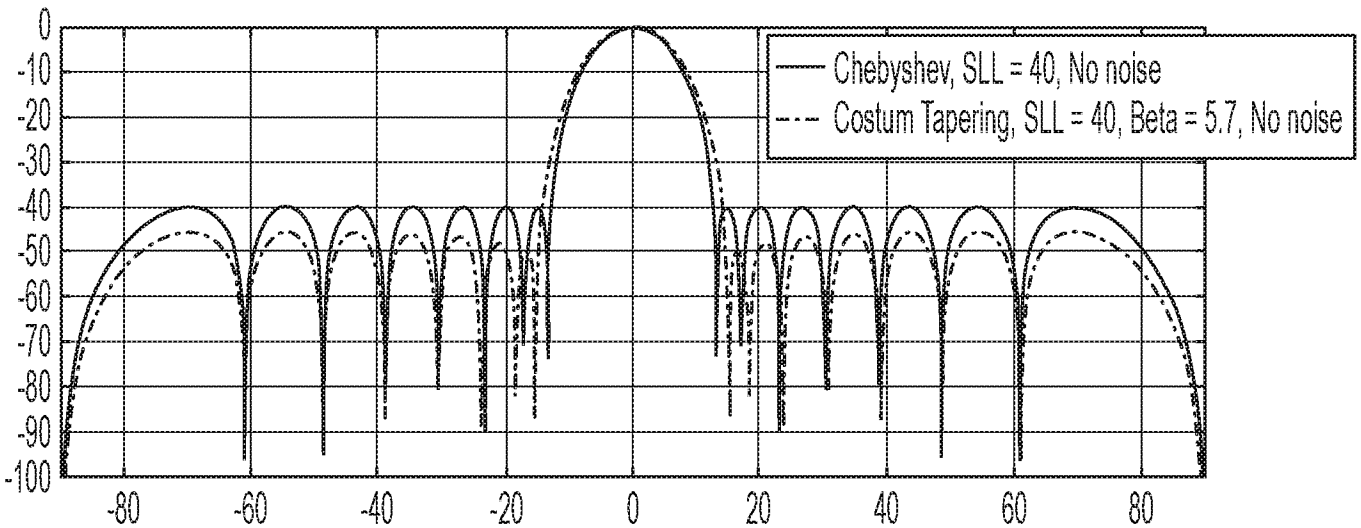
FIGS. 9A and 9B depict the performance of an amplitude tapering function that combines Chebyshev and Kaiser coefficients applied on a rectangular array of isotropic antenna elements in accordance with various embodiments.
Figure 9B:
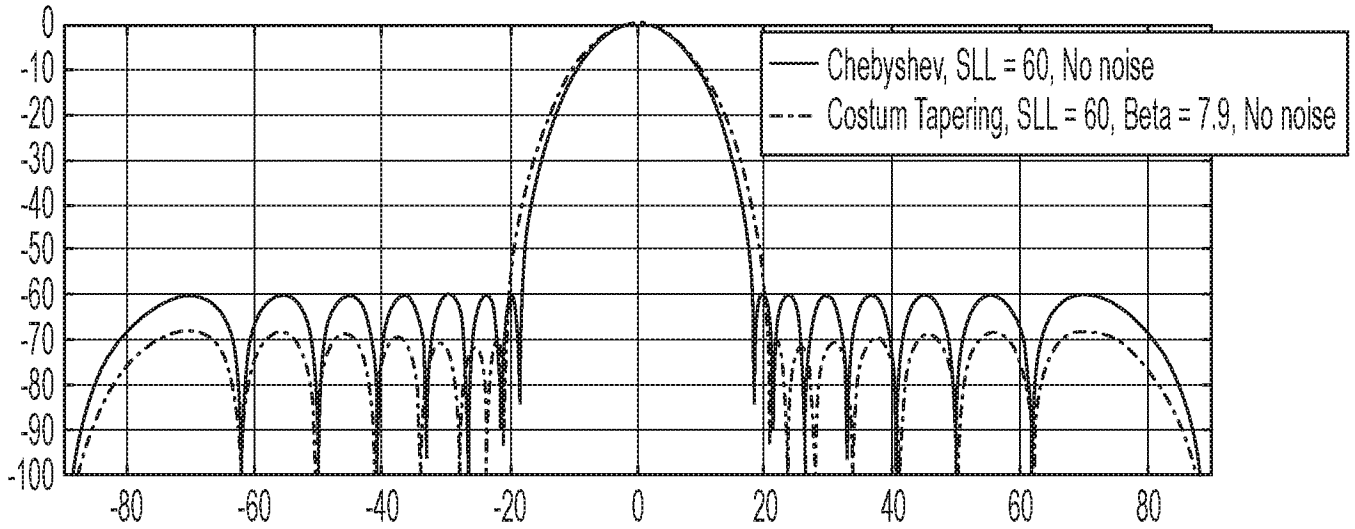

FIGS. 9A and 9B depict the performance of the above-described amplitude tapering function that combines Chebyshev and Kaiser coefficients. FIG. 9A shows the performance of the above-described amplitude tapering function applied on a 288 elements phased array operating at 77 GHz with 40 dB sidelobe level suppression and β set at 5.7. FIG. 9B shows the performance of the above-described amplitude tapering function applied on a 288 elements phased array operating at 77 GHz with 60 dB sidelobe level suppression and β set at 7.9. For this illustrative tapering technique, optimum values of β and α were calculated using an optimization algorithm in MATLAB to achieve lower sidelobe level of 40 dB (FIG. 9A) and 60 dB (FIG. 9B), respectively, compared to standard Chebyshev tapering. As is shown in FIGS. 9A and 9B, the sidelobes are reduced by an additional 6 dB (FIG. 9A) and 9 dB (FIG. 9B) relative to standard Chebyshev tapering without sacrificing the main lobe bandwidth and while maintaining sidelobe flatness.

Although reference is made herein to the accompanying set of drawings that form part of this disclosure, one of at least ordinary skill in the art will appreciate that various adaptations and modifications of the embodiments described herein are within, or do not depart from, the scope of this disclosure. For example, aspects of the embodiments described herein may be combined in a variety of ways with each other. Therefore, it is to be understood that, within the scope of the appended claims, the claimed invention may be practiced other than as explicitly described herein.

Unless otherwise indicated, all numbers expressing feature sizes, amounts, and physical properties used in the specification and claims may be understood as being modified either by the term "exactly" or "about." Accordingly, unless indicated to the contrary, the numerical parameters set forth in the foregoing specification and attached claims are approximations that can vary depending upon the desired properties sought to be obtained by those skilled in the art utilizing the teachings disclosed herein or, for example, within typical ranges of experimental error.

The recitation of numerical ranges by endpoints includes all numbers subsumed within that range (e.g. 1 to 5 includes 1, 1.5, 2, 2.75, 3, 3.80, 4, and 5) and any range within that range. Herein, the terms "up to" or "no greater than" a number (e.g., up to 50) includes the number (e.g., 50), and the term "no less than" a number (e.g., no less than 5) includes the number (e.g., 5).

The terms "coupled" or "connected" refer to elements being attached to each other either directly (in direct contact with each other) or indirectly (having one or more elements between and attaching the two elements). Either term may be modified by "operatively" and "operably," which may be used interchangeably, to describe that the coupling or connection is configured to allow the components to interact to carry out at least some functionality (for example, a radio chip may be operably coupled to an antenna element to provide a radio frequency electric signal for wireless communication).

Terms related to orientation, such as "top," "bottom," "side," and "end," are used to describe relative positions of components and are not meant to limit the orientation of the embodiments contemplated. For example, an embodiment described as having a "top" and "bottom" also encompasses embodiments thereof rotated in various directions unless the content clearly dictates otherwise.

Reference to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout are not necessarily referring to the same embodiment of the disclosure. Furthermore, the particular features, configurations, compositions, or characteristics may be combined in any suitable manner in one or more embodiments.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

As used herein, "have," "having," "include," "including," "comprise," "comprising" or the like are used in their open-ended sense, and generally mean "including, but not limited to." It will be understood that "consisting essentially of" "consisting of," and the like are subsumed in "comprising," and the like. The term "and/or" means one or all of the listed elements or a combination of at least two of the listed elements.

The phrases "at least one of" "comprises at least one of" and "one or more of" followed by a list refers to any one of the items in the list and any combination of two or more items in the list.

What is claimed is:

1. A phased array antenna system, comprising:

a feeding network comprising power combiners/dividers and an amplitude tapering system; and a plurality of antenna elements coupled to the feeding network;

wherein the amplitude tapering system is configured to generate amplitude coefficients and apply an amplitude tapering function on a transmitted or received radio frequency signal, and the amplitude tapering function comprises a combination of a least two disparate amplitude tapering functions; and wherein the amplitude tapering function comprises differing amplitude weights which, when applied to signals applied to or received from the plurality of antenna elements, produce an antenna pattern with reduced sidelobes and narrower main lobe bandwidth relative to an antenna pattern producible by application of any one of the at least two disparate amplitude tapering functions.

2. The system of claim 1, comprising:

a plurality of phase shifters each coupled to one of the plurality of antenna elements and the feeding network; and a phase control operatively coupled to the plurality of phase shifters, the phase control configured to adjust a phase shift of each of the phase shifters to electronically steer an antenna array pattern.

3. The system of claim 1, wherein each of the at least two disparate amplitude tapering functions provides a different tradeoff between main lobe bandwidth and sidelobe level suppression.

4. The system of claim 1, wherein the at least two disparate amplitude tapering functions comprise at least two of a Chebyshev amplitude tapering function, a Kaiser amplitude tapering function, a Hamming amplitude tapering function, a Hann amplitude tapering function, a Taylor amplitude tapering function, a Blackman amplitude tapering function, a Gaussian amplitude tapering function, a Bartlett amplitude tapering function, a Barthann amplitude tapering function, and a Tukey amplitude tapering function.

5. The system of claim 1, wherein the amplitude tapering function comprises a linear combination of coefficients of the at least two disparate amplitude tapering functions.

6. The system of claim 1, wherein the amplitude tapering function comprises coefficients of the at least two disparate amplitude tapering functions multiplied together.

7. The system of claim 1, wherein the amplitude tapering function comprises a convolution of coefficients of the at least two disparate amplitude tapering functions.

8. The system of claim 1, wherein the amplitude taper function comprises a weighting parameter applied to an array factor of the phased array antenna, the weighting parameter comprising a linear combination of coefficients of the at least two disparate amplitude tapering functions.

9. The system of claim 1, wherein the plurality of antenna elements are configured as one of a linear, a non-linear, a rectangular, and a circular phased array antenna.

10. A phased array antenna system, comprising:

a feeding network comprising power combiners/dividers and an amplitude tapering system; and a plurality of antenna elements coupled to the feeding network;

wherein the amplitude tapering system is configured to generate amplitude coefficients and apply an amplitude tapering function on a transmitted or received radio frequency signal, and the amplitude tapering function comprises a combination of a Chebyshev amplitude taper function and a Kaiser amplitude taper function such that a relative amplitude of a radio frequency signal applied to or received from each of the antenna elements is determined by a combination of Kaiser and Chebyshev amplitude taper coefficients; and wherein the amplitude tapering function comprises differing amplitude weights which, when applied to signals applied to or received from the plurality of antenna elements, produce an antenna pattern with reduced sidelobes and narrower main lobe bandwidth relative to an antenna pattern producible by application of only one of the Chebyshev amplitude tapering function and the Kaiser amplitude tapering function.

11. The system of claim 10, comprising:

a plurality of phase shifters each coupled to one of the plurality of antenna elements and the feeding network; and a phase control operatively coupled to the plurality of phase shifters, the phase control configured to adjust a phase shift of each of the phase shifters to electronically steer an antenna array pattern.

12. The system of claim 10, wherein the amplitude tapering function comprises a linear combination of Chebyshev and Kaiser amplitude tapering function coefficients.

13. The system of claim 10, wherein the amplitude tapering function comprises Chebyshev and Kaiser amplitude tapering function coefficients multiplied together.

14. The system of claim 10, wherein the amplitude tapering function comprises a convolution of Chebyshev and Kaiser amplitude tapering function coefficients.

15. The system of claim 10, wherein the amplitude tapering function is a linear combination of coefficients derived from:

a Chebyshev amplitude tapering coefficient, s, which determines sidelobe level suppression with respect to main lobe peak; and a Kaiser amplitude tapering coefficient, $\beta$, which determines a tradeoff between main lobe bandwidth and sidelobe level suppression.

16. The system of claim 10, wherein the amplitude taper function comprises a weighting parameter applied to an array factor of the phased array antenna, the weighting parameter comprising a linear combination of Chebyshev and Kaiser amplitude taper function coefficients.

17. The system of claim 10, wherein the plurality of antenna elements are configured as one of a linear, a non-linear, a rectangular, and a circular phased array antenna.

18. A method implemented by a phased array antenna system, comprising:

transmitting or receiving radio frequency signals by a phased array antenna coupled to a feeding network comprising power combiners/dividers and an amplitude tapering system;

applying, by the amplitude tapering system, an amplitude tapering function on a transmitted or received radio frequency signal, the amplitude tapering function comprising a combination of a least two disparate amplitude tapering functions; and producing an antenna pattern with reduced sidelobes and narrower main lobe bandwidth relative to an antenna pattern producible by application of any one of the at least two disparate amplitude tapering functions;

wherein the amplitude tapering function comprises:

coefficients of the at least two disparate amplitude tapering functions multiplied together; or a convolution of coefficients of the at least two disparate amplitude tapering functions.

19. The method of claim 18, wherein the at least two disparate amplitude tapering functions comprise at least two of a Chebyshev amplitude tapering function, a Kaiser amplitude tapering function, a Hamming amplitude tapering function, a Hann amplitude tapering function, a Taylor amplitude tapering function a Blackman amplitude tapering function, a Gaussian amplitude tapering function, a Bartlett amplitude tapering function, a Barthann amplitude tapering function, and a Tukey amplitude tapering function.

20. The method of claim 18, wherein the at least two disparate amplitude tapering functions comprise a Chebyshev amplitude tapering function and a Kaiser amplitude tapering function.

* * * * *